US005343896A

United States Patent [19]

Schroder et al.

[11] Patent Number: 5,343,896

[45] Date of Patent: Sep. 6, 1994

[54] PAPERMAKERS FABRIC HAVING STACKED MACHINE DIRECTION YARNS

[75] Inventors: Ernst Schroder, Eupen, Belgium; Henry J. Lee, Summerville, S.C.

[73] Assignee: Asten Group, Inc., Charleston, S.C.

[21] Appl. No.: 951,081

[22] Filed: Sep. 25, 1992

Related U.S. Application Data

[63] Continuation-in-part of Ser. No. 829,985, Feb. 3, 1992, Pat. No. 5,230,371, which is a continuation-in-part of Ser. No. 534,164, Jun. 6, 1990, Pat. No. 5,103,874, and a continuation-in-part of Ser. No. 654,008, Feb. 14, 1991, Pat. No. 5,117,865, and a continuation-in-part of Ser. No. 567,974, Aug. 15, 1990, Pat. No. 5,092,373.

[51] Int. Cl.[5] ..... D03D 13/00; D03D 15/00

[52] U.S. Cl. ..... 139/383 A; 428/225

[58] Field of Search ..... 139/383 A; 428/225

[56] References Cited

U.S. PATENT DOCUMENTS

| | | | |
|---|---|---|---|
| 1,050,406 | 1/1913 | Veit . | |
| 1,268,788 | 6/1918 | Brooks . | |
| 2,854,032 | 8/1953 | Santos . | |
| 3,622,415 | 11/1971 | Kunsman . | |
| 3,815,645 | 6/1974 | Codorniv . | |
| 3,885,603 | 5/1975 | Slaughter | 139/383 A |
| 4,026,331 | 5/1977 | Lees et al. . | |
| 4,123,022 | 10/1978 | Dutt et al. . | |
| 4,142,557 | 3/1979 | Kositzke . | |
| 4,290,209 | 9/1981 | Buchanan et al. . | |
| 4,351,874 | 9/1982 | Kirby . | |
| 4,356,225 | 10/1982 | Dufour . | |
| 4,379,735 | 4/1983 | MacBean . | |
| 4,438,788 | 3/1984 | Harwood . | |
| 4,438,789 | 9/1984 | MacBean . | |
| 4,461,803 | 7/1984 | Booth et al. . | |
| 4,469,142 | 9/1984 | Harwood . | |
| 4,515,853 | 5/1985 | Borel . | |
| 4,529,013 | 7/1985 | Miller . | |
| 4,537,816 | 8/1985 | Booth et al. . | |
| 4,569,375 | 1/1986 | Borel . | |
| 4,601,785 | 7/1986 | Lilja et al. . | |
| 4,621,663 | 11/1986 | Malmendier . | |
| 4,705,601 | 11/1987 | Chiu . | |
| 4,737,241 | 4/1988 | Gulya . | |
| 4,755,420 | 7/1988 | Baker et al. . | |
| 4,815,499 | 3/1989 | Johnson . | |
| 4,824,525 | 4/1989 | Penven . | |
| 4,846,231 | 7/1989 | Penven . | |
| 4,865,083 | 9/1989 | Cunnane . | |
| 4,883,096 | 11/1989 | Penven . | |
| 4,887,648 | 12/1989 | Cunnane . | |
| 4,902,383 | 2/1990 | Penven . | |
| 4,921,750 | 5/1990 | Todd . | |
| 4,938,269 | 7/1990 | Nicholas et al. . | |
| 4,991,630 | 2/1991 | Penven . | |
| 4,995,429 | 2/1991 | Kositzke | 139/383 A |
| 5,066,532 | 11/1991 | Gaisser . | |
| 5,103,874 | 4/1992 | Lee | 139/383 A |
| 5,114,777 | 5/1992 | Gaisser . | |
| 5,164,249 | 11/1992 | Tyler et al. | 139/383 A X |
| 5,169,709 | 12/1992 | Fleischer | 139/383 A |
| 5,199,467 | 4/1993 | Lee | 139/383 A |

FOREIGN PATENT DOCUMENTS

| | | | |
|---|---|---|---|
| 2407291 | 5/1979 | European Pat. Off. . | |
| 0144592 | 6/1985 | European Pat. Off. . | |
| 0211426 | 2/1987 | European Pat. Off. . | |
| 3225599 | 1/1984 | Fed. Rep. of Germany | 139/383 A |

*Primary Examiner*—Andrew M. Falik
*Attorney, Agent, or Firm*—Volpe and Koenig

[57] ABSTRACT

A papermakers fabric having a system of monofilament machine direction yarns (hereinafter MD yarns) which control the permeability of the fabric. The present weave provides for usage of high aspect ratio yarns as structural weave components. The system of MD yarns comprises multiple layers of yarns which are vertically stacked. Preferably, upper MD yarns define floats on the upper surface of the fabric and each upper MD yarn is grouped in a vertically stacked orientation with an intermediate and a lower MD yarn.

20 Claims, 6 Drawing Sheets

FIG. 9
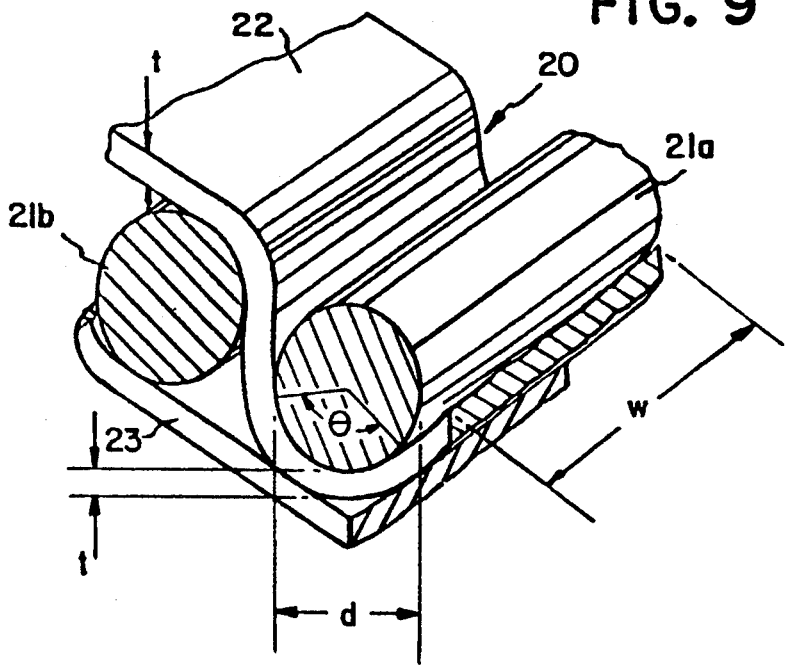
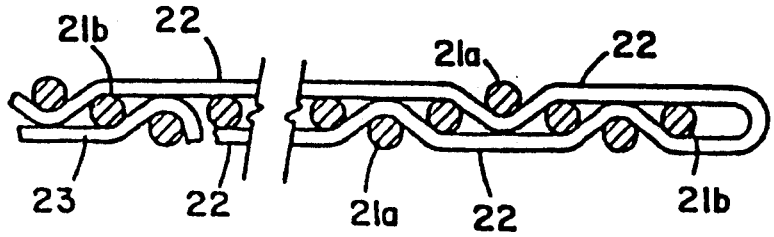
FIG. 10
FIG. 11
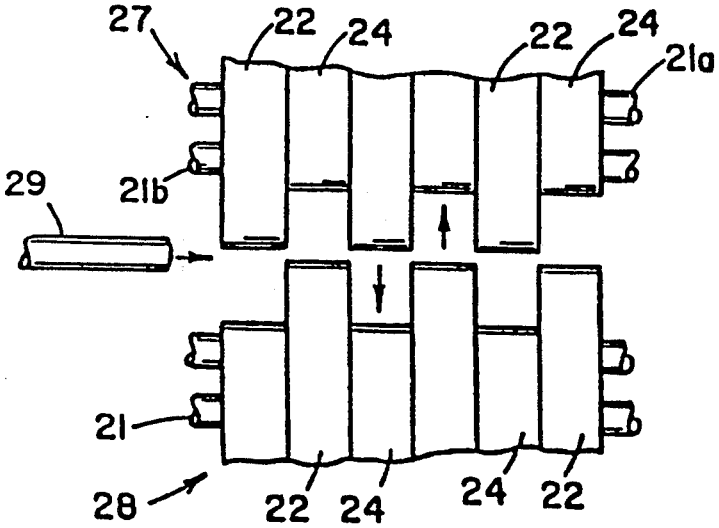

PAPERMAKERS FABRIC HAVING STACKED MACHINE DIRECTION YARNS

This application is a continuation-in-part of copending application Ser. No. 07/829,985 U.S. Pat. No. 5,230,371, filed Feb. 3, 1992, entitled PAPERMAKERS FABRIC HAVING DIVERSE FLAT MACHINE DIRECTION YARN SURFACES, which in turn was a continuation-in-part of application Ser. No. 07/534,164, filed Jun. 6, 1990, entitled PAPERMAKERS FABRIC WITH STACKED MACHINE DIRECTION YARNS U.S. Pat. No. 5,103,874; Ser. No. 07/654,008, filed Feb. 14, 1991, entitled PAPER MAKERS FABRIC WITH FLAT HIGH ASPECT RATIO YARNS U.S. Pat. No. 5,117,865; and Ser. No. 07/567,974, filed Aug. 15, 1990, entitled PAPERMAKERS FABRIC WITH ORTHOGONAL MACHINE DIRECTION YARN SEAMING LOOPS U.S. Pat. No. 5,092,373.

The present invention relates to papermakers fabrics and in particular to fabrics comprised of stacked machine direction monofilament yarns.

BACKGROUND OF THE INVENTION

Papermaking machines generally are comprised of three sections: forming, pressing, and drying. Papermakers fabrics are employed to transport a continuous paper sheet through the papermaking equipment as the paper is being manufactured. The requirements and desirable characteristics of papermakers fabrics vary in accordance with the particular section of the machine where the respective fabrics are utilized.

With the development of synthetic yarns, shaped monofilament yarns have been employed in the construction of papermakers fabrics. For example, U.S. Pat. No. 4,290,209 discloses a fabric woven of flat monofilament warp yarns; U.S. Pat. No. 4,755,420 discloses a non-woven construction where the papermakers fabric is comprised of spirals made from flat monofilament yarns.

Numerous weaves are known in the art which are employed to achieve different results. For example, U.S. Pat. No. 4,438,788 discloses a dryer fabric having three layers of cross machine direction yarns interwoven with a system of flat monofilament machine direction yarns such that floats are created on both the top and bottom surfaces of the fabric. The floats tend to provide a smooth surface for the fabric.

Permeability is an important criteria in the design of papermakers fabrics. In particular, with respect to fabrics made for running at high speeds on modern drying equipment, it is desirable to provide dryer fabrics with relatively low permeability.

U.S. Pat. No. 4,290,209 discloses the use of flat monofilament warp yarns woven contiguous with each other to provide a fabric with reduced permeability. However, even where flat warp yarns are woven contiguous with each other, additional means, such as stuffer yarns, are required to reduce the permeability of the fabric. As pointed out in that patent, it as desirable to avoid the use of fluffy, bulky stuffer yarns to reduce permeability which make the fabric susceptible to picking up foreign substances or retaining water.

U.S. Pat. No. 4,290,209 and U.S. Pat. No. 4,755,420 note practical limitations in the aspect ratio (cross-sectional width to height ratio) of machine direction warp yarns defining the structural weave of a fabric. The highest practical aspect ratio disclosed in those patents is 3:1, and the aspect ratio is preferably, less than 2:1.

U.S. Pat. No. 4,621,663, assigned to the assignee of the present invention, discloses one attempt to utilize high aspect ratio yarns (on the order of 5:1 and above) to define the surface of a papermakers dryer fabric. As disclosed in that patent, a woven base fabric is provided to support the high aspect ratio surface yarns. The woven base fabric is comprised of conventional round yarns and provides structural support and stability to the fabric disclosed in that patent.

U.S. Pat. No. 4,815,499 discloses the use of flat yarns in the context of a forming fabric. That patent discloses a composite fabric comprised of an upper fabric and a lower fabric tied together by binder yarns. The aspect ratio employed for the flat machine direction yarns in both the upper and lower fabrics are well under 3:1.

In use, papermakers fabrics are configured as endless belts. Weaving techniques are available to initially weave fabrics endless. However, there are practical limitations on the overall size of endless woven fabrics as well as inherent installation difficulties. Moreover, not all papermaking equipment is designed to accept the installation of an endless fabric.

Flat woven fabrics are often supplied having opposing ends which are seamed together during installation of the fabric on papermaking equipment. Usually one end of the fabric is threaded through the serpentine path defined by the papermaking equipment and is then joined to its opposing end to form a continuous belt.

A variety of seaming techniques are well known in the art. One conventional method of seaming is to form the machine direction yarns on each end of the fabric into a series of loops. The loops of the respective fabric ends are then intermeshed during fabric installation to define a channel through which a pintle is inserted to lock the ends together.

For example, U.S. Pat. Nos. 4,026,331; 4,438,789; 4,469,142; 4,846,231; 4,824,525 and 4,883,096 disclose a variety of pin seams wherein the machine direction yarns are utilized to form the end loops. In each of those patents, however, the machine direction yarn projects from the end of the fabric and weaves back into the fabric adjacent to itself. Accordingly, the loops inherently have a twist or torque factor and are not entirely orthogonal to the plane of the fabric. U.S. Pat. No. 4,883,096 specifically addresses this problem.

It would be desirable to provide a papermakers fabric with machine direction seaming loops which do not have torque and/or twist.

Additionally, the opposing sides of a papermakers fabric generally serve distinct functions. One side being utilized to carry the aqueous paper web; the other side being in contact with the various rolls and other mechanisms of the papermaking machine. It would be desirable to provide a true two-sided dual characteristic papermakers fabric designed to facilitate the distinct requirements for the opposing fabric sides.

SUMMARY AND OBJECTS INVENTION

The present invention provides a papermakers fabric having a system of flat monofilament machine direction yarns (hereinafter MD yarns) which are stacked to control the permeability of the fabric. The present weave also provides for usage of high aspect ratio yarns as structural weave components. The system of MD yarns comprises at least upper and lower yarns which are vertically stacked. Preferably, the upper MD yarns define floats on the upper surface of the fabric and each upper MD yarn is paired in a vertically stacked orientation with a lower MD yarn. The lower MD yarns may weave in an inverted image of the upper MD yarns to provide floats on the bottom fabric surface or may weave with a different repeat to provide a different surface on the bottom of the fabric.

The upper MD yarns may be flat monofilament yarns woven contiguous with each other to reduce the permeability of the fabric and to lock in the machine direction alignment of the stacking pairs of MD yarns. A stacked, contiguous woven machine direction system provides stability and permits the MD yarns to have a relatively high aspect ratio, cross-sectional width to height, a greater than 3:1. Machine direction yarns further define a series of orthogonal seaming loops on the opposing fabric ends. End segments of the lower MD yarns are removed and the upper MD yarn ends are looped back upon themselves and rewoven into the fabric end in the space vacated by the trimmed lower MD yarn end segments. The lower MD yarns may weave in an inverted image of the upper MD yarns such that the crimp of the upper MD yarns conformed with the lower MD yarn weave pattern space into which the upper MD yarn ends are backwoven. This improves the strength of the seam.

Non-loop forming upper MD yarns are also preferably backwoven into the space vacated by trimming the respective lower MD yarns. The upper MD yarns may be woven contiguous with each other to lock in the machine direction alignment of the stacking pairs of MD yarns and the orthogonal orientation of the end loops.

In a preferred embodiment, the same type of material and the same geometric shape and size yarns are used throughout each layer of the machine direction yarn system. Additionally, at least one intermediate layer of MD yarns is provided and intermediate MD yarns are stacked between the upper and the lower MD yarns, respectively.

It is an object of the invention to provide a papermakers fabric having permeability controlled with woven flat machine direction yarns.

It is a further object of the invention to provide a low permeability fabric constructed of all monofilament yarns without the use of bulky stuffer yarns and without sacrificing strength or stability.

Other objects and advantages will become apparent from the following description of presently preferred embodiments.

BRIEF DESCRIPTION OF DRAWINGS

FIG. 9 is a perspective view of a portion of the fabric illustrated in FIGS. 6–8;

FIG. 10 illustrates the yarn orientation in the finished fabric depicted in FIG. 6 showing the end loop formed by one of the MD yarns;

FIG. 11 is a top view of the opposing ends of a fabric constructed in accordance with FIG. 6 just prior to pin-seaming the ends together;

DETAILED DESCRIPTION OF PRESENTLY PREFERRED EMBODIMENTS

Figure 1:
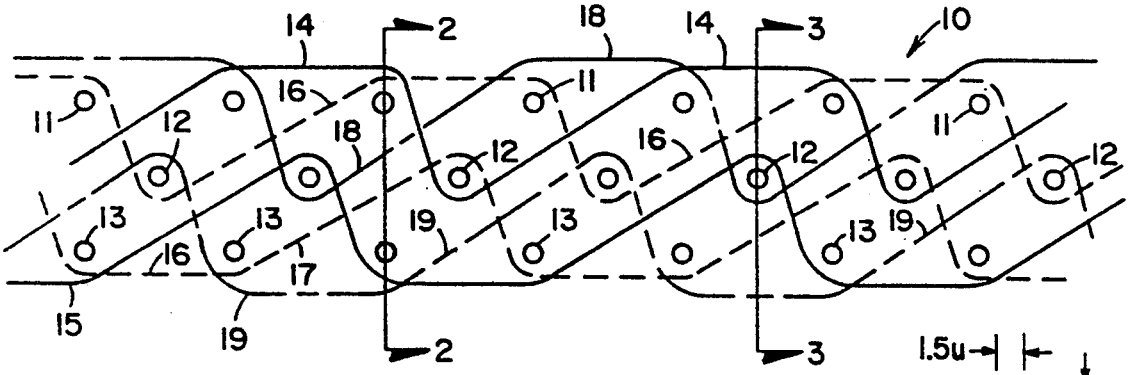
FIG. 1 is a schematic diagram of a papermakers fabric made in accordance with the teachings of the present invention.
Figure 3B:
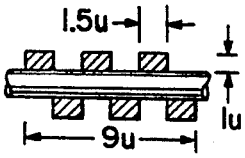
FIG. 3b PRIOR ART
FIG. 3*b* is a cross-sectional view of a prior art weave construction.
Figure 2:
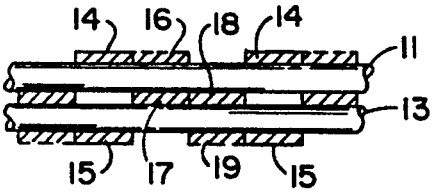
FIG. 2 is a cross-sectional view of the fabric depicted in FIG. 1 along line 2—2.
Figure 3A:
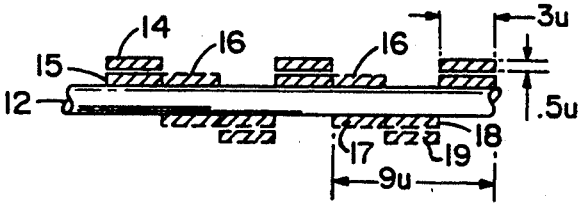
FIG. 3*a* is a cross-sectional view of the fabric depicted in FIG. 1 along line 3—3.

Referring to FIGS. 1, 2, and 3*a*, there is shown a papermakers dryer fabric 10 comprising upper, middle and lower layers of cross machine direction (hereinafter CMD) yarns 11, 12, 13, respectively, interwoven with a system of MD yarns 14–19 which sequentially weave in a selected repeat pattern. The MD yarn system comprises upper MD yarns 14, 16, 18 which interweave with CMD yarns 11, 12 and lower MD yarns 15, 17, 19 which interweave with CMD yarns 12, 13.

The upper MD yarns 14, 16, 18 define floats on the top surface of the fabric 10 by weaving over two upper layer CMD yarns 11 dropping into the fabric to weave in an interior knuckle under one middle layer CMD yarn 12 and under one CMD yarn 11 and thereafter rising to the surface of the fabric to continue the repeat of the yarn. The floats over upper layer CMD yarns 11 of upper MD yarns 14, 16, 18 are staggered so that all of the upper and middle layer CMD yarns 11, 12 are maintained in the weave.

As will be recognized by those skilled in the art, the disclosed weave pattern with respect to FIGS. 1, 2, and 3*a*, results in the top surface of the fabric having a twill pattern. Although the two-float twill pattern represented in FIGS. 1, 2, and 3*a* is a preferred embodiment, it will be recognized by those of ordinary skill in the art that the length of the float, the number of MD yarns in the repeat, and the ordering of the MD yarns may be selected as desired so that other patterns, twill or non-twill, are produced.

As best seen in FIGS. 2 and 3*a*, lower MD yarns 15, 17, 19, weave directly beneath upper MD yarns 14, 16, 18, respectively, in a vertically stacked relationship. The lower yarns weave in an inverted image of their respective upper yarns. Each lower MD yarn 15, 17, 19 floats under two lower layer CMD yarns 13, rises into the fabric over one CMD yarn 13 and forms a knuckle around one middle layer CMD yarn 12 whereafter the yarn returns to the lower fabric surface to continue its repeat floating under the next two lower layer CMD yarns 13.

With respect to each pair of stacked yarns, the interior knuckle, formed around the middle layer CMD yarns 12 by one MD yarn, is hidden by the float of the other MD yarn. For example, in FIGS. 1 and 3*a*, lower MD yarn 15 is depicted weaving a knuckle over CMD yarn 12 while MD yarn 14 is weaving its float over CMD yarns 11, thereby hiding the interior knuckle of lower MD yarn 15. Likewise, with respect to FIGS. 1 and 3*a*, upper MD yarn 18 is depicted weaving a knuckle under yarn CMD yarn 12 while it is hidden by lower MD yarn 19 as it floats under CMD yarns 13.

The upper MD yarns 14, 16, 18, may be woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein (and used herein), actual warp count in a woven fabric may vary between about 80%–125% in a single layer and still be considered 100% warp fill.

The crowding of MD yarns 14, 16, and 18 also serves to force MD yarns 15, 17, 19, into their stacked position beneath respective MD yarns 14, 16, 18. MD yarns 15, 17, and 19 may be the same size as MD yarns 14, 16, and 18 so that they are likewise woven 100% warp fill. This results in the overall fabric having 200% warp fill of MD yarns.

If the lower MD yarns 15, 17, 19 are also woven 100% warp fill, they likewise have the effect of maintaining the upper MD yarns 14, 16, 18 in stacked relationship with the respect to lower MD yarns 15, 17, 19. Accordingly, the respective MD yarn pairs 14 and 15, 16 and 17, 18 and 19 are doubly locked into position thereby enhancing the stability of the fabric.

As set forth in the U.S. Pat. No. 4,290,209, it has been recognized that machine direction flat yarns will weave in closer contact around cross machine direction yarns than round yarns. However, a 3:1 aspect ratio was viewed as a practical limit for such woven yarns in order to preserve overall fabric stability. The present stacked MD yarn system preserves the stability and machine direction strength of the fabric and enables the usage of yarns with increased aspect ratio, in a preferred range of 2:1 to 6:1, to more effectively control permeability.

The high aspect ratio of the MD yarns translates into reduced permeability. High aspect ratio yarns are wider and thinner than conventional flat yarns which have aspect ratios less than 3:1 and the same cross-sectional area. Equal cross-sectional area means that comparable yarns have substantially the same linear strength. The greater width of the high aspect ratio yarns translates into fewer interstices over the width of the fabric than with conventional yarns so that fewer openings exist in the fabric through which fluids may flow. The relative thinness of the high aspect ratio yarns enables the flat MD yarns to more efficiently cradle, i.e. brace, the cross machine direction yarns to reduce the size of the interstices between machine direction and cross machine direction yarns.

For example, as illustrated in FIG. 3*b*, a fabric woven with a single layer system of a flat machine direction warp having a cross-sectional width of 1.5 units and a cross-sectional height of 1 unit, i.e. an aspect ratio of 1.5:1, is shown. Such fabric could be replaced by a fabric having the present dual stacked MD yarn system with MD yarns which are twice the width, i.e. 3 units, and half the height, i.e. 0.5 units. Such MD yarns thusly having a fourfold greater aspect ratio of 6:1, as illustrated in FIG. 3*a*.

The thinner, wider MD yarns more efficiently control permeability while the machine direction strength of the fabric remains essentially unaltered since the cross-sectional area of the MD yarns over the width of the fabric remains the same. For the above example, illustrated by FIGS. 3*a* and 3*b*, the conventional single MD yarn system fabric has six conventional contiguous flat yarns over 9 units of the fabric width having a cross-sectional area of 9 square units, i.e. 6*(1u.*1.5u.). The thinner, wider high aspect ratio yarns, woven as contiguous stacked MD yarns, define a fabric which has three stacked pairs of MD yarns over 9 units of fabric width. Thus such fabric also has a cross-sectional area of 9 square units, i.e. (3*(0.5u.*b 3u.))+(3*(0.5u.*3u.)), over 9 units of fabric width.

In one example, a fabric was woven in accordance with FIGS. 1, 2 and 3, wherein the CMD yarns 11, 12, 13 were polyester monofilament yarns 0.6 mm in diameter interwoven with MD yarns 14–19 which were flat polyester monofilament yarns having a width of 1.12 mm and a height of 0.2 mm. Accordingly, the aspect ratio of the flat MD yarns was 5.6:1. The fabric was woven at 48 warp ends per inch with a loom tension of 40 pli (pounds per linear inch) and 12.5 CMD pick yarns per inch per layer (three layers).

The fabric was heat set in a conventional heat setting apparatus under conditions of temperature, tension and time within known ranges for polyester monofilament yarns. For example, conventional polyester fabrics are heat set within parameters of 340° F.–380° F. temperature, 6–15 pli (pounds per linear inch) tension, and 3–4 minutes time. However, due to their stable structure, the fabrics of the present invention are more tolerant to variations in heat setting parameters.

The fabric exhibited a warp modulus of 6000 PSI (pounds per square inch) measured by the ASTM D-1682-64 standard of the American Society for Testing and Materials. The fabric stretched less that 0.2% in length during heat setting. This result renders the manufacture of fabrics in accordance with the teachings of the present invention very reliable in achieving desired dimensional characteristic as compared to conventional fabrics.

The resultant heat set fabric had 12.5 CMD yarns per inch per layer with 106% MD warp fill with respect to both upper and lower MD yarns resulting in 212% actual warp fill for the fabric. The finished fabric has a permeability of 83 cfm as measured by the ASTM D-737-75 standard.

Figure 4A:
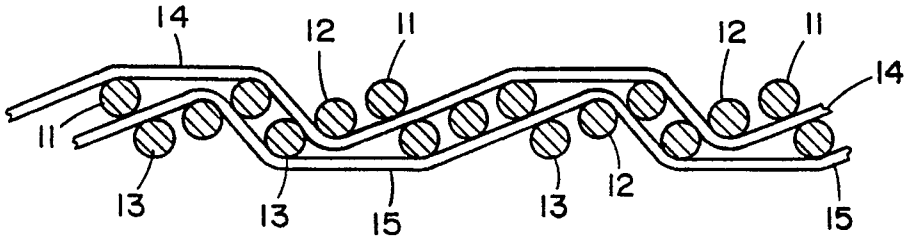
FIG. 4*a* illustrates the yarn orientation in the fabric depicted in FIG. 1 after the fabric is finished showing only two representative stacked MD yarns.

As illustrated in FIG. 4*a*, when the fabric 10 is woven the three layers of CMD yarns 11, 12, 13 become compressed. This compression along with the relatively thin dimension of the MD yarns reduces the caliper of the fabric. Accordingly, the overall caliper of the fabric can be maintained relatively low and not significantly greater than conventional fabrics woven without stacked MD yarn pairs. In the above example, the caliper of the finished fabric was 0.050 inches.

It will be recognized by those of ordinary skill in the art that if either top MD yarns 14, 16, 18 or bottom MD yarns 15, 17, 19 are woven at 100% warp fill, the overall warp fill for the stacked fabric will be significantly greater than 100% which will contribute to the reduction of permeability of the fabric. The instant fabric having stacked MD yarns will be recognized as having a significantly greater percentage of a warp fill than fabrics which have an actual warp fill of 125% of non-stacked MD yarns brought about by crowding and lateral undulation of the warp strands. The fabric may be woven having 100% fill for either the upper or lower MD yarns with a lesser degree of fill for the other MD yarns by utilizing yarns which are not as wide as those MD yarns woven at 100% warp fill. For example, upper yarns 14, 16, 18 could be 1 unit wide with lower layer yarns 15, 17, 19 being 0.75 units wide which would result in a fabric having approximately 175% warp fill.

Such variations can be used to achieve a selected degree of permeability. Alternatively, such variations could be employed to make a forming fabric. In such a case, the lower MD yarns would be woven 100% warp fill to define the machine side of the fabric and the upper MD yarns would be woven at a substantially lower percentage of fill to provide a more open paper forming surface.

Figure 4B:
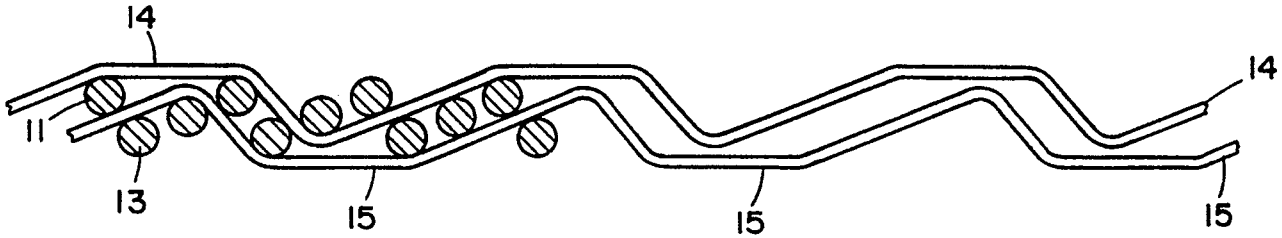
FIGS. 4*b*, 4*c*, and 4*d* are a series of illustrations showing the formation of a seaming loop for the papermakers fabric depicted in FIG. 1.
Figure 4C:
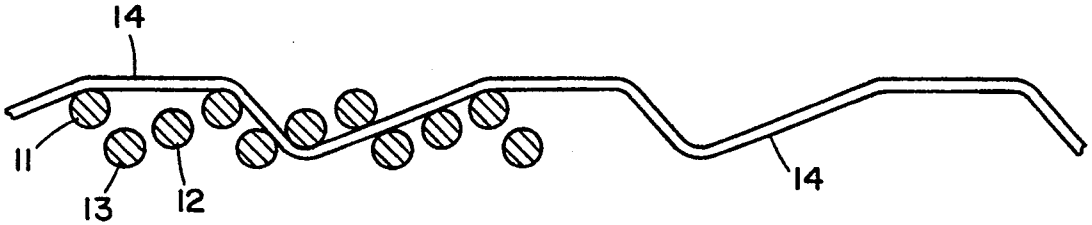
Figure 4D:
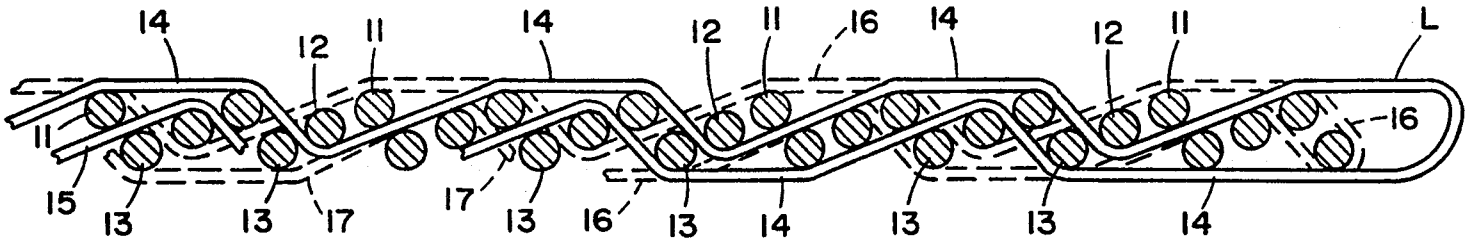

The stacked pair MD weave permits the formation of orthogonal seaming loops within MD yarns. With reference to FIGS. 4*a–d*, after the fabric has been woven and heat set (FIG. 4*a*), CMD yarns are removed leaving the crimped MD yarns 14, 15 exposed (FIG. 4*b*). One of the yarns, for example, MD lower yarn 15, of the stacked pair is trimmed back a selected distance leaving the other exposed MD yarn 14 of the MD yarn pair and vacated space between the CMD yarns, as illustrated in FIG. 4*c*. Upper MD yarn 14 is then backwoven into the space vacated in the weave pattern by lower MD yarn 15 such that a loop L is formed on the end of the fabric, as illustrated in FIG. 4*d*. Preferably, between 0.5–5.0 inches of upper layer yarn 14 is backwoven into the fabric to provide sufficient strength for the end loop and assure retention of the free end of MD yarn 14 within the weave of the fabric. The inverted image weave permits the crimp of the upper MD yarn 14 to match the space vacated by the lower MD yarn 15 which further enhances the strength of the end loop.

As shown in phantom in FIG. 4*d*, adjacent yarn pair 16, 17 is processed in a similar manner. However, when upper yarn 16 is looped back and backwoven in the fabric, it is pulled against the CMD yarns. Where the upper MD yarns are woven 100% fill, the crowding of the yarns secure the orthogonal orientation of the seaming loops.

To achieve a uniform seam for a fabric woven in accordance with the weave pattern depicted in FIG. 1, each upper MD yarn 14 forms a loop and the other upper MD yarns 16, 18 are backwoven against the end-most CMD yarn of the fabric. Thus every third upper MD yarn defines a loop such that an array of loops is created on each end of the fabric. The seam is assembled by intermeshing the opposing arrays of loops and inserting a pintle yarn between the intermeshed loops.

Preferably, loop forming yarns 14 would all be backwoven approximately the same distance within the fabric to provide sufficient strength to prevent the loops from being pulled apart during normal usage. Non-loop forming yarns 16, 18, would preferably be backwoven a somewhat shorter distance since during usage no load is imparted to those yarns. For example, upper MD yarns 14 would be backwoven approximately 3 inches, MD yarns 16 would be backwoven approximately 2 inches, and MD yarns 18 would be backwoven approximately 1 inch. Respective lower layer yarns 15, 17, 19 would be trimmed to complement the backweaving of their respective MD yarn pair yarns 14, 16, 18.

Figure 5A:
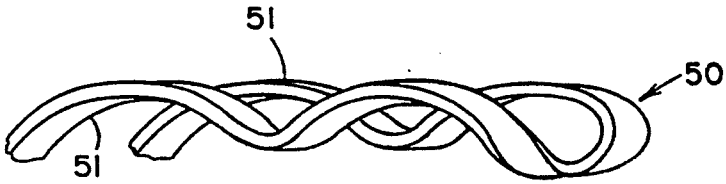
FIG. 5a (PRIOR ART)
FIG. 5*a* is a perspective view of a prior art MD yarn seaming loop.
Figure 5B:
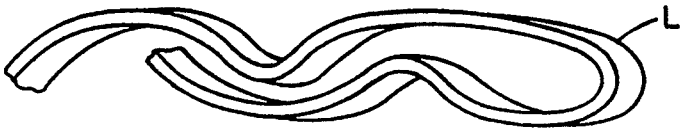
FIG. 5*b* is a perspective view of an orthogonal MD yarn seaming loop made in accordance with the present invention.

FIGS. 5*a* and 5*b*, respectively, illustrate a conventional seaming loop 50 in comparison with an orthogonal seaming loop L of the present invention. In conventional loop forming techniques, the MD yarn 51 is backwoven into the fabric adjacent to itself thereby inherently imparting twist and/or torque to the loop structure 50. In the present invention, the MD yarn is looped directly beneath itself and does not have any lateral offset which would impart such twist or torque to the seaming loop.

Figure 6:
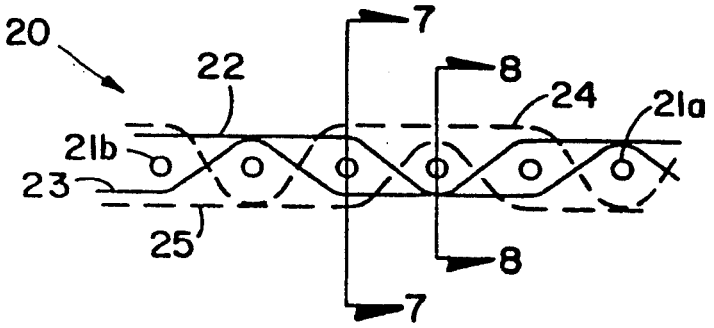
FIG. 6 is a schematic view of a second embodiment of a fabric made in accordance with the present invention.
Figure 7:
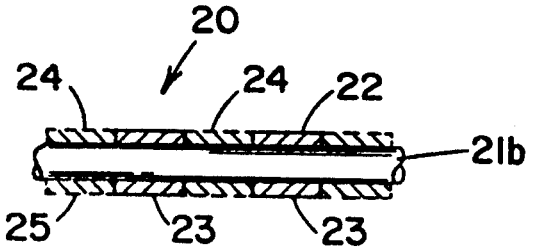
FIG. 7 is a cross-sectional view of the fabric depicted in FIG. 6 along line 7—7.
Figure 8:
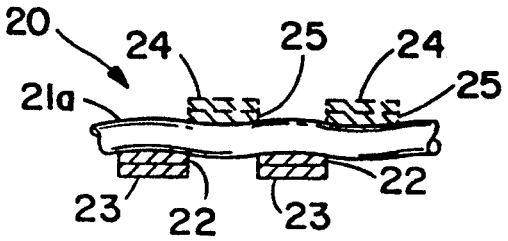
FIG. 8 is a cross-sectional view of the fabric depicted in FIG. 6 along line 8—8.

Referring to FIGS. 6, 7 and 8, there is shown a second preferred embodiment of a fabric 20 made in accordance with the teachings of the present invention. Papermakers fabric 20 is comprised of a single layer of CMD yarns 21*a*, 21*b* interwoven with a system of stacked MD yarns 22–25 which weave in a selected repeat pattern. The MD yarn system comprises upper MD yarns 22, 24 which define floats on the top surface of the fabric 20 by weaving over three CMD yarns, under the next one CMD yarn 21*a* to form a knuckle, and thereafter returning to float over the next three CMD yarns in a continuation of the repeat.

Lower MD yarns 23, 25, weave directly beneath respective upper MD yarns 22, 24 in a vertically stacked relationship. The lower MD yarns weave in an inverted image of their respective upper MD yarns. Each lower MD yarn 23, 25 floats under three CMD yarns, weaves upwardly around the next one CMD yarn 21*a* forming a knuckle and thereafter continues in the repeat to float under the next three CMD yarns.

As can be seen with respect to FIGS. 6 and 8, the knuckles formed by the lower MD yarns 23, 25 are hidden by the floats defined by the upper MD yarns 22, 24 respectively. Likewise the knuckles formed by the upper MD yarns 22, 24 are hidden by the floats of the lower MD yarns 23, 25 respectively.

The caliper of the fabric proximate the knuckle area shown in FIG. 8, has a tendency to be somewhat greater than the caliper of the fabric at non-knuckle CMD yarns 21*b*, shown in FIG. 7. However, the CMD yarns 21*a* around which the knuckles are formed become crimped which reduces the caliper of the fabric in that area as illustrated in FIG. 8. Additionally, slightly larger diameter CMD yarns are preferably used for CMD yarns 21*b*, shown in FIG. 7, which are not woven around as knuckles by the MD yarns to eliminate any difference in fabric caliber. Preferably the diameter of the larger CMD yarn 21*b* equals the diameter d of the smaller CMD yarns 21*a* plus the thickness t of the MD yarns.

In one example, a fabric was woven in accordance with FIGS. 6–9, wherein the CMD yarns 21*a*, 21*b* were polyester monofilament yarns 0.6 mm and 0.8 mm, respectively, in diameter interwoven with MD yarns 22–25 which were flat polyester monofilament yarns having a width of 1.12 mm and a height of 0.2 mm. Accordingly, the aspect ratio of the flat MD yarns was 5.6:1. The fabric was woven at 48 total warp ends per inch with a loom tension of 40 pli (pounds per linear inch) and 20 CMD total pick yarns per inch. The permeability averaged 90 cfm in the resultant fabric.

In another example, fabric was woven in accordance with FIGS. 6, 7 and 8, wherein the CMD yarns 21*a*, 21*b* were polyester monofilament yarns 0.7 mm in diameter interwoven with MD yarns 22-25 which were flat polyester monofilament yarns having a width of 1.12 mm and a height of 0.2 mm. Accordingly, the aspect ratio of the flat MD yarns was 5.6:1. The fabric was woven at 22 CMD pick yarns per inch. The fabric was heat set using conventional methods. The fabric exhibited a modulus of 6000 psi. The fabric stretched less than 0.2% in length during heat setting. The resultant fabric had 22 CMD yarns per inch with 106% MD warp fill with respect to both upper and lower MD yarns resulting in 212% actual warp fill for the fabric. The finished fabric had a caliper of 0.048 inches and an air permeability of 60 cfm.

As best shown in FIG. 9, the high aspect ratio yarns 22–25 effectively brace the CMD yarns 21*a* in the weave construction. This bracing effect can be quantified in terms of the degree of contact arc $\theta$ and contact bracing area, CBA, as follows:

$$CBA = \pi d\left(\frac{\theta}{360^\circ}\right)w$$

where d=diameter of the CMD yarn $\theta$=the degree of arc over which there is contact between the MD and CMD yarns w=width of the MD yarn $\pi$=the constant pi.

The degrees of arc over which MD yarns 22–25 are in contact with CMD yarns 21*a* is dependent upon the spacing of the CMD yarns within the weave. For the above example, employing alternating 0.6 mm and 0.8 mm diameter CMD yarns with 0.2 mm thick MD yarns, the degree of contact arc can be maintained in a preferred range of between 60° to 180° by varying the pick count of the CMD yarns from 14 picks per inch to a maximum of 28.22 picks per inch.

In the preferred embodiment where the pick count is 20 picks per inch, the degree of contact arc $\theta$ is approximately 101°. This results in a bracing contact area of approximately 0.79 $mm^2$ at each knuckle in the fabric.

Applicant's use of high ratio aspect yarns, i.e. yarns having a width:thickness ratio of at least 3:1, provides for increased bracing contact of the flat MD yarns with the CMD yarns 21*a*. This is comparatively exemplified by modifying the equation for contact bracing area, CBA, to be defined in terms of the thickness of the MD yarns.

Since the MD yarn width w equals the thickness t of the MD yarn multiplied by the aspect ratio, $w>3t$ for yarns having an aspect ratio greater than 3:1. Accordingly, fabrics made in accordance with the teachings of the present invention utilizing high aspect ratio MD yarns exhibit enhanced bracing of the CMD yarns by the MD yarns such that:

$$CBA > \pi d\left(\frac{\theta}{360^\circ}\right)3t.$$

The single layer fabric structure depicted in FIGS. 6–9 is particularly useful in the creation of a true two-sided, dual characteristic fabric. This is accomplished by using one type of yarn for the upper MD yarns 22, 24 and a different type of yarn for the lower MD yarns 23, 25. Additionally, a third type of yarn may be used for the CMD yarns which are essentially shielded from both the machine side and the paper carrying side of the fabric by the upper and lower layers of warp yarns.

In a preferred embodiment of a single layer, two-sided, dual characteristic papermakers fabric having the structure disclosed in FIGS. 6–8, three different types of yarns are used. Yarns made of nylon 6, 6 with heat stabilizer, which are commercially available from Asten Monotech, Inc., are used for the upper paper carrying MD layer yarns. Yarns made of polyester (PET) with hydrolysis additive are utilized for the lower machine side MD yarns. A hydrolysis-resistant yarn made of polyphenylene sulfide (PPS), commercially available from Shakespeare Corporation as HPA-40, or yarn made of plycycloterephthalate acid resin (PCTA) available from Albany International, Inc. are utilized for the CMD yarns. Such a combination of yarn types is particularly suited for the construction of a dryer fabric which is subject to a variety of heat and moisture environmental factors. Polyester yarns are particularly susceptible to hydrolytic action. Accordingly, polyester yarns are placed on the machine side and protected by the nylon, paper carrying side of the fabric which is recognized as having hydrolysis resistance superior to that of polyester. Yarns such as HPA-40, also known as Ryton TM are relatively inert to hydrolysis. However, Ryton TM yarns are prone to abrasion and are presently more costly than Nylon or polyester yarns. In the CMD position, the Ryton TM yarns are protected from abrasion and enhance the hydrolysis resistance of the fabric. Polycycloterephthalate acid resin (PCTA) is less expensive than Ryton TM and also possess hydrolysis resistance superior to polyester.

Preferably, for a dryer fabric application where a relatively low permeability fabric of 70–150 cfm is desired, the geometry of the upper layer nylon 6, 6 yarns 22, 24 and lower layer polyester MD yarns 23, 25 are both 0.25 mm by 1.06 mm and the size of the Ryton TM CMD yarns alternates between 0.55 mm and 0.80 mm for yarns 21*a* and 21*b*, respectively. The fabric is woven with a total of 48 MD yarn ends per inch, 24 top layer and 24 bottom layer ends, with the CMD yarns woven 16–22 yarns per inch. The fabric is heat set at a tension in the range of 8–15 pounds per linear inch preferably utilizing the upper end of the range to achieve the smoothest surface. Preferably, a hot oil cylinder method of heat setting at a speed of about 3 feet per minute, with a temperature no greater than 360 degrees is used where the polyester surface is in contact with the cylinder. However, conventional hot air oven heat setting may also be utilized.

For a dryer fabric application where a relatively high permeability fabric if 200–400 cfm is desired, the geometry of the upper layer nylon 6, 6 yarns 22, 24 and lower layer polyester MD yarns 23, 25 are both 0.30 mm by 0.80 mm and the size of the Ryton TM CMD yarns alternates between 0.500 mm and 0.80 mm for yarns 21*a* and 21*b*, respectively. The fabric is woven with a total of 48 MD yarn ends per inch 24 top layer and 24 bottom layer ends, with the CMD yarns woven 16–24 yarns per inch.

Although the number of MD ends per inch is the same as the low permeability fabric, the difference in cross-sectional dimensions of the MD yarns results in the high permeability fabric having a warp fill of about 75% in each MD layer in contrast to the 100% warp fill of the low permeability fabric.

The fabric is heat set at a tension in the range of 8–15 pounds per linear inch preferably utilizing the upper end of range to achieve the smoothest surface. Preferably, a hot oil cylinder method of heat setting at a speed of about 3 feet per minute, with a temperature no greater than 360 degrees is used where the polyester surface is in contact with the cylinder. However, conventional hot air oven heat setting may also be utilized.

For wet press felts and forming applications, different types of yarns may be used for the upper MD yarns, lower MD yarns, and CMD yarns respectively to achieve desired characteristics. Such characteristics may be dictated by both physical and economic reasons in the design of fabric. In some instance it may be desirable to have different types of yarns dispensed within the same MD layer or CMD layer.

As best seen in FIG. 10, seaming loops are formed by upper MD yarns 22. The respective lower MD yarns 23 are trimmed a selected distance from the fabric end and the upper MD yarns 22 are backwoven into the space vacated by the trimmed lower MD yarns 23.

Upper MD yarns 24 are similarly backwoven into the space vacated by trimming back lower MD yarns 25. However, as best seen in FIG. 10, upper MD yarns 24 are backwoven against the endmost CMD yarn 21*b*.

As illustrated in FIG. 11, a series of seaming loops is formed on each of the opposing fabric ends 27, 28. When the fabric is installed on papermaking equipment, the respective end loops formed by MD yarns 22 are intermeshed and a pintle 30 is inserted therethrough to lock the intermeshed series of loops together.

Since the seaming loops L are formed by backweaving MD yarns 22 directly beneath themselves, no lateral twist or torque is imparted on the loop and the loops are orthogonal with the plane of the fabric. This facilitates the intermeshing of the loop series of the opposing fabric ends 27, 28. The orthogonal loops are particularly advantageous where, as shown in FIG. 10, the MD yarns 22, 24 are 100% warp fill and adjacent loops are separated by individual MD yarns of the same width as the loop MD yarns 22. Lateral torque or twist on the seaming loops make the seaming process more difficult particularly where the loop-receiving gaps between the loops of one fabric end are essentially the same width as the loops on the opposing fabric end and vice versa.

With reference to the fabric depicted in FIGS. 6–11, the loop forming MD yarns 22 are preferably backwoven approximately 2 inches while the non-loop forming MD yarns 24 are preferably backwoven 1 inch.

Alternatively, the seaming loops may be formed in a similar manner from lower MD yarns 23. In such case, upper MD yarns 22 would be trimmed back a selected distance from the end of the fabric permitting the lower MD yarns 23 to be backwoven in the space vacated by the upper MD yarns 22. This alternative may be preferred in the case where different types of yarns are used for the upper and lower MD yarns respectively. In such case, due to the selection of yarn material, the lower MD yarns may provide better physical properties for the seaming loops.

Figure 12:
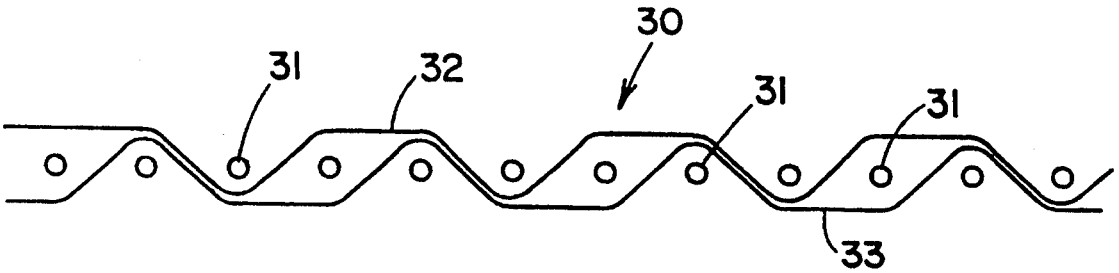
FIG. 12 is a schematic view of a third alternate embodiment of a fabric made in accordance with the teachings of the present invention showing only one pair of stacked MD yarns.

With reference to FIG. 12, a third embodiment of a papermakers fabric 30 is shown. Fabric 30 comprises a single layer of CMD yarns 31 interwoven with stacked pairs of flat monofilament yarns in a selected repeat pattern. For clarity, only one pair of stacked MD yarns is shown comprising upper MD yarn 32 and lower MD yarn 33. The upper MD yarns weave in a float over two CMD yarns 31, form a single knuckle under the next CMD yarn 31 and thereafter repeat. Similarly the lower MD yarns weave in an inverted image of the upper MD yarns weaving under two CMD yarns 31, forming a knuckle over the next CMD yarn 31 and then returning to the bottom surface of the fabric in the repeat. Since the repeat of both the upper and lower MD yarns is with respect to three CMD yarns 31, a total of three different stacked pairs of yarns comprise the weave pattern of the MD yarn system.

A fabric was woven in accordance with FIG. 12 wherein the CMD yarns 31 were polyester monofilament yarns 0.7 mm in diameter interwoven with MD yarns which were flat polyester monofilament yarns having a width of 1.12 mm and a height of 0.2 mm. Accordingly, the aspect ratio of the flat MD yarns was 5.6:1. The fabric was woven 48 warp ends per inch under a loom tension of 60 pli and 18 CMD pick yarns per inch. The fabric was heat set using conventional methods. The fabric exhibited a modulus of 6000 psi. The fabric stretched less than 0.2% in length during heat setting. The resultant fabric had 18 CMD yarns per inch with 106% MD warp fill with respect to both upper and lower MD yarns resulting in 212% actual warp fill for the fabric. The finished fabric having a caliper of 0.046 inches and an air permeability of 66 cfm.

Figure 13:
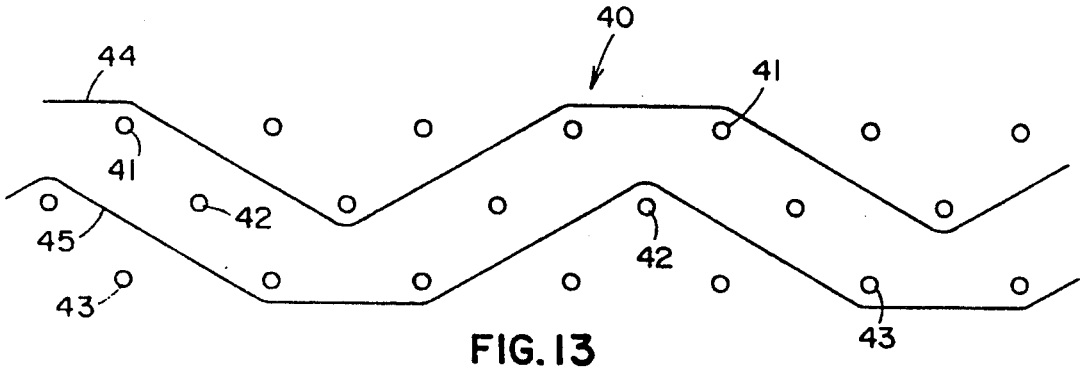
FIG. 13 is a schematic view of a fourth alternate embodiment of a fabric made in accordance with the teachings of the present invention showing only one pair of stacked MD yarns.

With reference to FIG. 13, a fourth embodiment of a papermakers fabric 40 is shown. Fabric 40 comprises upper, middle and lower layers of CMD yarns 41, 42, 43, respectively, interwoven with stacked pairs of flat monofilament yarns in a selected repeat pattern. For clarity, only one pair of stacked MD yarns is shown comprising upper MD yarn 44 and lower MD yarn 45. The upper MD yarns weave in a float over two upper layer CMD yarns 41, under the next yarn 41 and a middle layer yarn 42 to form a single knuckle, under the next CMD yarn 41 and thereafter rise to the top surface to continue to repeat. Similarly, the lower MD yarns weave in an inverted image of the upper MD yarns weaving under two lower layer CMD yarns 43 over the next CMD yarn 43 and a middle CMD yarn 42 forming a knuckle, over the next CMD yarn 43 then returning to the bottom surface of the fabric to repeat. Since the repeat of both the upper and lower MD yarns is with respect to four upper and lower CMD yarns 41, 43, respectively, a total of four different stacked pairs of yarns comprise the weave pattern of the MD yarn system.

A fabric was woven in accordance with FIG. 13, wherein the upper and lower layer CMD yarns 41, 43 were nylon-sheathed, multifilament polyester yarns 0.62 mm in diameter and the middle layer CMD yarns 42 were polyester monofilament yarns 0.5 mm in diameter interwoven with MD yarns 22–25 which were flat polyester monofilament yarns having a width of 0.60 mm and a height of 0.38 mm. Accordingly, the aspect ratio of the flat MD yarns was 1.58:1. The fabric was woven with 96 warp ends per inch under a loom tension of 40 pli and 15 CMD pick yarns per inch per layer. The fabric was heat set using conventional methods. The resultant fabric had 15 CMD yarns per inch per layer with 113% MD warp fill with respect to both upper and lower MD yarns resulting in 226% actual warp fill for the fabric. The finished fabric had a caliper of 0.075 inches and an air permeability of 60 cfm.

Figure 14:
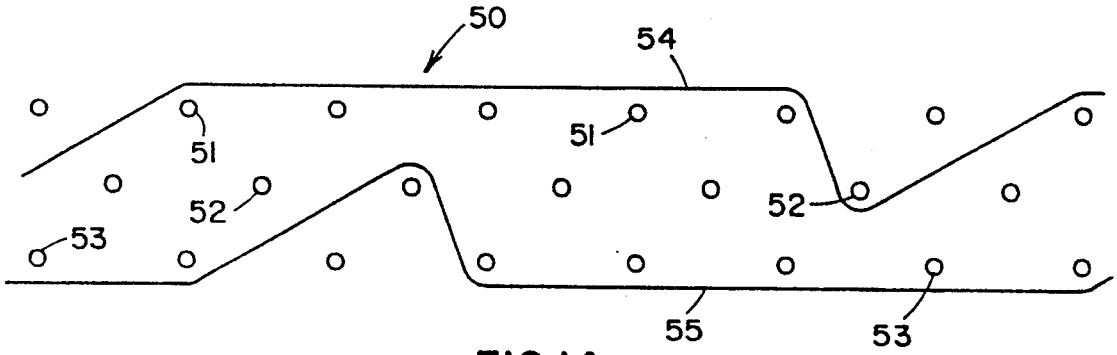
FIG. 14 is a schematic view of a fifth alternate embodiment of a fabric made in accordance with the teachings of the present invention showing only one pair of stacked MD yarns.
Figure 15:
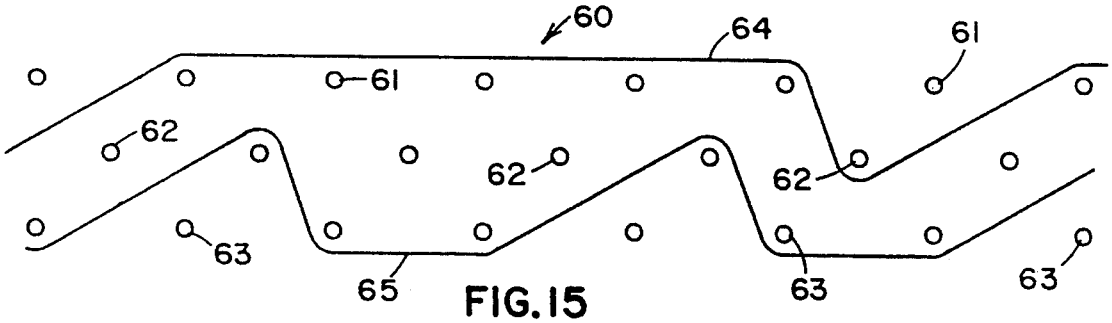
FIG. 15 is a schematic view of a sixth alternate embodiment of a fabric made in accordance with the teachings of the present invention showing only one pair of stacked MD yarns.
Figure 16:
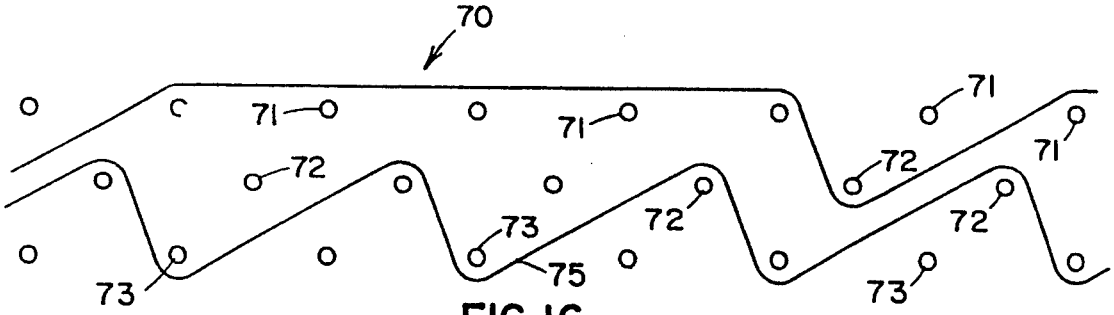
FIG. 16 is a schematic view of a seventh alternate embodiment of a fabric made in accordance with the teachings of the present invention showing only one pair of stacked MD yarns.
Figure 17:
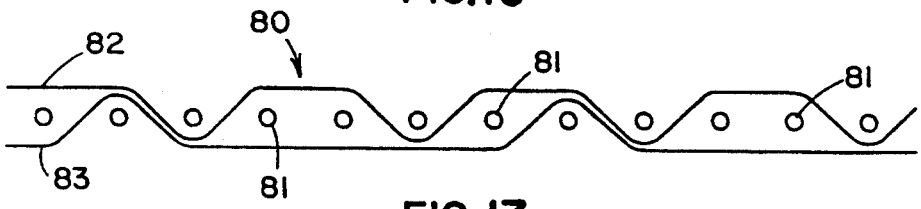
FIG. 17 is a schematic view of a eighth alternate embodiment of a fabric made in accordance with the teachings of the present invention showing only one pair of stacked MD yarns.

FIGS. 14, 15 and 16 illustrate the fifth, sixth and seventh embodiments of the present invention. FIG. 14 illustrates the weave of a relatively long float on both sides of the fabric; FIG. 15 illustrates how a stacked pair MD yarn weave can define floats of different lengths on opposite sides of the fabric; and FIG. 16 illustrates how a stacked pair MD yarn weave can be used to construct fabrics having MD knuckles on one side of the fabric.

Relatively long floats predominating the surfaces of a dryer fabric are beneficial for both the paper-carrying side as well as the machine side of the fabric. On the paper-carrying side, long floats provide greater contact area with the paper sheet for increased heat transfer. On the machine side, long floats provide increased wear surface and contact area to reduce bounce and flutter. The stacked pair MD yarn weave is versatile in allowing different surfaces to be defined on the top and bottom sides of the fabric. Accordingly, fabrics made in accordance with the teachings of the present invention may be used for other industrial purposes such as in the drying of sludge.

With respect to FIG. 14, a fabric 50 is illustrated comprising three layers of yarns 51, 52, and 53 respectively. In this construction, the MD yarn pairs, such as the pair formed by upper layer yarn 54 and lower layer yarn 55, define relatively long floats on both the top and bottom surfaces of the fabric. Upper yarn 54 weaves over five upper layer CMD yarns 51, drops into the fabric to form a knuckle under one middle layer CMD yarn 52, weaves under the next upper layer yarn 51 and thereafter repeats. Lower MD yarn 55 weaves in an inverted image under five lower layer CMD yarns 53, rising into the fabric over the next CMD 53 to weave a knuckle over one middle layer CMD yarn 52 thereafter dropping to the bottom surface of the fabric to continue its repeat. In such a construction, six pairs of stacked MD yarns are utilized in the repeat of the fabric and are sequentially woven in a selected sequence to produce a desired pattern on the surfaces of the fabric which will be predominated by the MD yarn floats.

The embodiment shown in FIG. 15 depicts a fabric 60 in which the MD yarns weave with a five-float repeat on the top fabric surface and a two-float repeat on the bottom fabric surface. For example, upper MD yarn 64 interweaves with upper and middle CMD yarns 61, 62 in the same manner that upper MD yarn 54 weaves with respective CMD yarns 51, 52 with respect to fabric 50 in FIG. 14. However, lower MD yarn 65, which forms a stacked pair with upper MD yarn 64, weaves in a two-float bottom repeat with respect lower and middle CMD yarns 63, 62. For example, lower MD yarn 65 floats under two lower layer CMD yarns 63, rises above the next CMD yarn 63 to form a knuckle over one middle layer CMD yarn 62 and thereafter drops to the bottom surface of the fabric 60 to continue to repeat. As with the other embodiments discussed above, the interior knuckles formed by the lower MD yarns are hidden by the upper MD yarn of the respective stacked pair and vice-versa.

The construction shown in FIG. 15 permits different surfaces to be defined on the top and bottom of the fabric while utilizing the benefits of the stacked MD yarn pairing.

The embodiment shown in FIG. 16 discloses another example of a fabric 70 having five-float MD yarns predominating the upper surface of the fabric, but with MD knuckles on the lower surface of the fabric. This type of construction may be advantageously used to construct a forming fabric where the upper fabric surface, having relatively long floats, would be used as the machine side of the fabric and the knuckled lower surface of the fabric would be used as the paper forming ride.

Fabric 70 includes three layers of CMD yarns 71, 72, 73 respectively which interweave with stacked pairs of MD yarns to define this construction. Only one pair of stacked pair of MD yarns 74, 75 is depicted for clarity. Upper MD yarn 74 weaves in a five-float pattern with respect to upper and middle layer CMD yarns 71, 72 in the same manner as upper MD yarn 54 with respect to fabric 50 shown in FIG. 14. Lower MD yarn 75 weaves three interior knuckles and three lower surface knuckles with respect to middle and lower layer CMD yarns 72, 73 under each upper surface float of its respective MD yarn pair yarn 74. The repeat of the upper MD yarns is defined with respect to six upper layer CMD yarns 71 and the repeat of the lower MD yarns is defined with respect to only two lower layer CMD yarns 73. Accordingly, there are six different pairs of stacked MD yarns which constitute the MD yarn system which, as noted above, can be arranged such that a desired pattern is formed on the upper surface of the fabric.

Generally for stacked pair weaves, the repeat of the upper MD yarns will be equally divisible by, or an equal multiple of, the repeat of the lower MD yarns in defining the stacking pair relationship. For example, with respect to FIG. 12 the repeat of the upper MD yarns is six upper layer CMD yarns which is equally divisible by the repeat of the lower MD yarns which is three lower layer CMD yarns.

Figure 18:
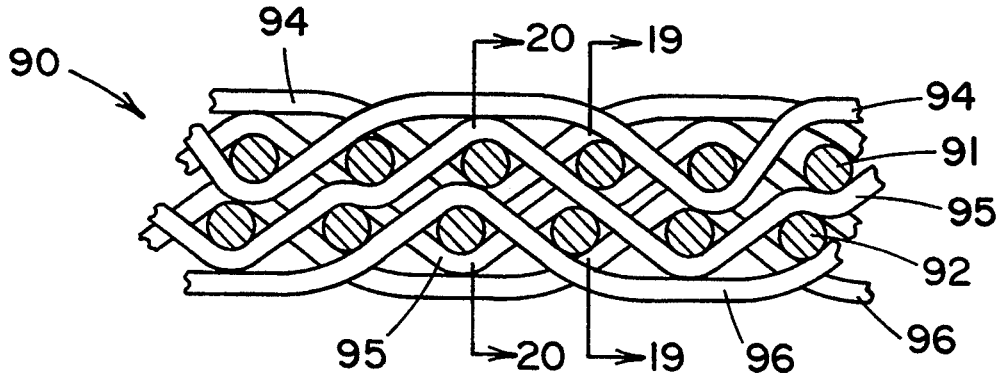
FIG. 18 is a cross-sectional view of a ninth alternate embodiment of a fabric made in accordance with the teachings of the present invention which includes a layer of intermediate MD yarns stacked between the MD yarns of the upper and lower MD yarn layers.

With respect to the ninth alternate embodiment shown in FIG. 18, a fabric 90 is illustrated having a single layer of CMD yarns 81 and a representative stacked pair of MD yarns 82, 83. Upper MD yarn 82 weaves with two floats over CMD yarns 81 with a repeat occurring with respect to three CMD yarns 81. Lower MD yarn 83 weaves with five floats under CMD yarns 81 with a repeat of six CMD yarns 81. Thus, in fabric 80, the repeat of the upper MD yarns, which is three, is an equal multiple of the repeat of lower MD yarns, which is six.

Figure 19:
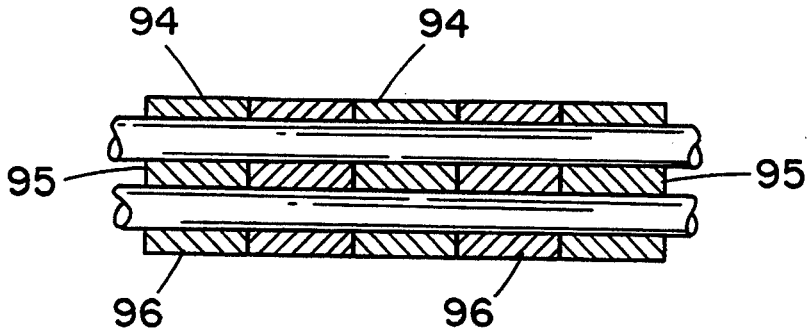
FIG. 19 is a cross-sectional view of the fabric depicted in FIG. 18 along line 19—19.
Figure 20:
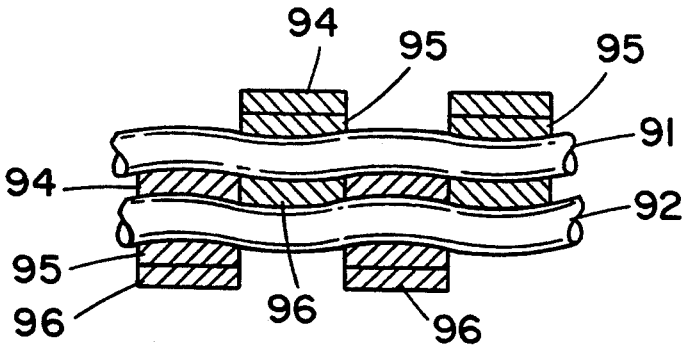
FIG. 20 is a cross-sectional view of the fabric depicted in FIG. 18 along line 20—20.

With reference to FIG. 18, 19 and 20 a ninth embodiment of a papermakers fabric 90 is shown. Fabric 90 comprises upper and lower layers of CMD yarns 91 and 92, respectively, interwoven with upper, intermediate and lower stacked layers of flat monofilament yarns in a selected repeat pattern. The MD yarn layers define stacked triplets of MD yarns comprising upper MD yarns 94, intermediate MD yarns 95 and lower MD yarns 96. The upper MD yarns 94 weave with upper CMD yarns 91 in a float over three upper layer CMD yarns 91, under the next yarn 91 to form a single knuckle, and thereafter rise to the top surface to continue to repeat. Similarly, the lower MD yarns 96 weave with lower CMD yarns 92 in an inverted image of the upper MD and CMD yarns. Lower MD yarns 96 weave under three lower layer CMD yarns 92, over the next CMD yarn 92 forming a knuckle, then return to the bottom surface of the fabric to repeat. Preferably, the knuckle formed by the upper MD yarns 94 is disposed above the middle of the float defined by the lower MD yarns 96 and vice versa.

The intermediate layer MD yarns 95 interweave with both the upper and lower CMD yarns 91, 92. Preferably, intermediate MD yarn 95 weaves under the lower CMD yarn 92 which is directly beneath the knuckle defined by upper MD yarn 94, weaves between the next CMD yarns 91, 92, weaves over the next CMD yarn 91 directly above the knuckle defined by lower MD yarn 96, weaves between the next CMD yarns 91, 92 and thereafter repeats. Although the repeat of the upper, intermediate and lower MD yarns is with respect to four pairs of upper and lower CMD yarns 91, 92, respectively, the upper and lower MD yarns 94, 96 weave knuckles with respect to only every other pair of CMD yarns 91, 93, respectively, such that every other stacked triplet of MD yarns weaves in the same manner with the same CMD yarns across the width of the fabric.

This weave pattern causes crimping of alternate CMD yarns, 91, 92 in a similar fashion as is discussed with respect to the single CMD layer fabric disclosed in FIGS. 6–9 above. As shown in FIG. 18, where the diameter of all of the CMD yarns 91, 92 are the same, the alternate CMD yarns 91, 92 which are crimped, tend to displace each other from vertical alignment to maintain a uniform caliper of the fabric.

Figure 21:
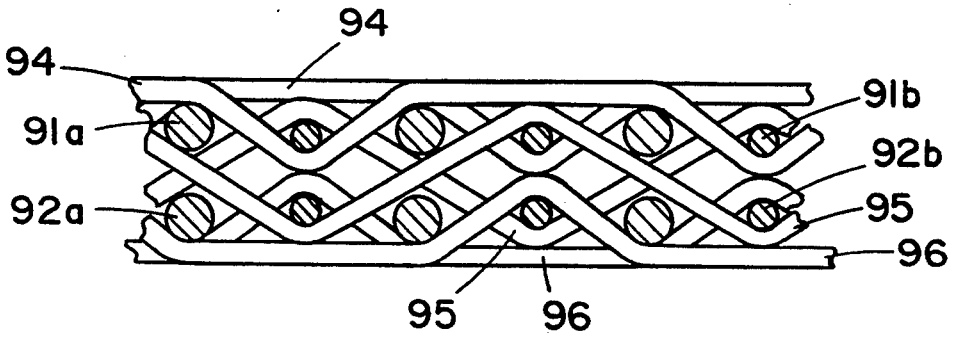
FIG. 21 is a cross-sectional view of a tenth alternate embodiment of a fabric made in accordance with the teachings of the present invention which includes a layer of intermediate MD yarns stacked between the MD yarns of the upper and lower MD yarn layers.

With reference to FIG. 21, there is shown a modification to the fabric 90 depicted in FIGS. 18–20. In place of CMD yarns 91, 92 which all have a uniform diameter, in FIG. 18, alternating large diameter yarns 91*a*, 92*a* and small diameter yarns 91*b*, 92*b* define the respective upper and lower layers of CMD yarns. This modification permits the fabric 90 to maintain a uniform caliper while retaining respective pairs of CMD yarns 91, 92 in vertical alignment. The crimp of the CMD yarns 91*b*, 92*b* around which the upper and lower MD yarns 94, 96 form knuckles is greater for the relatively small diameter CMD yarns of the FIG. 21 embodiment as compared to the fabric embodiment depicted in FIGS. 18–20. In both cases, the alternate CMD yarn pairs 91*a*, 92*a* exhibit virtually no crimp.

In one example, a fabric was woven with flat polyester monofilament warp yarn having cross-sectional dimensions of 0.20 mm by 1.10 mm. Each layer of MD warp yarns being woven at 22 ends per inch for a total of 66 MD yarns per inch. The CMD yarns were round polyester yarns alternating between 0.50 mm and 0.70 mm in diameter. Each CMD layer being woven at 21 yarns per inch for a total of 42 CMD yarns per inch. The permeability of the resultant fabric was 110 cfm.

A variety of other weave patterns employing the stacked weave construction of two, three or more layers of MD yarns of the instant invention may be constructed within the scope of the present invention.

What we claim is:

1. A woven papermakers fabric of the type having a paper side which is in contact with a paper sheet and a machine side which is in contact with machine rollers, the woven fabric being comprised of:

a first system of longitudinal, monofilament machine direction yarns that dominate the paper side of the fabric;

an intermediate system of longitudinal, monofilament machine direction yarns that do not appear on either the paper side or the machine side of the fabric;

a second system of longitudinal, monofilament machine direction yarns that dominate the machine side of the fabric; and a multilayer system of cross machine direction yarns, the yarns of the first, intermediate and second systems are arranged in vertically stacked groups of first, intermediate and second machine direction yarns positioned one above the other in a superimposed relationship and are interwoven with the yarns of the cross machine direction system in a repeated pattern that maintains the stacked relationship of the yarns such that the yarns of the first system do not pass to the machine side of the fabric, the yarns of the second system do not pass to the paper side of the fabric and the yarns of the intermediate system do not pass to either the paper or the machine side of the fabric and the intermediate yarns are interlaced with the cross machine direction yarns of at least two layers of said multilayer system.

2. A papermakers fabric according to claim 1 wherein at least said first and second systems of machine direction yarns are flat monofilament yarns.

3. A papermakers fabric according to claim 2 wherein said flat monofilament yarns have an aspect ratio of at least 3:1.

4. A papermakers fabric comprising:

a system of CMD yarns including at least upper and lower layers of CMD yarns;

a system of flat monofilament MD yarns interwoven with said CMD yarns in a selected repeat pattern;

said MD yarns system having paired upper and lower yarns that are stacked in the same relative vertical alignment to each other throughout the body of the fabric; and said MD yarn system including at least one subsystem of intermediate MD yarns disposed between said upper and lower MD yarns such that at least one intermediate MD yarn is in vertical stacked alignment with each stacked pair of upper and lower MD yarns.

5. A papermakers fabric according to claim 4 wherein said upper MD yarns are interwoven with floats over a selected number of said upper layer CMD yarns to define an upper surface of the fabric which is predominated by said upper MD yarn floats.

6. A papermakers fabric according to claim 5 wherein said lower MD yarns are interwoven with said lower layer CMD yarns in an inverted image of the repeat of the respective upper MD yarns of said MD yarn pairs whereby a bottom surface of the fabric is defined which is predominated by floats of said lower MD yarns.

7. A papermakers fabric according to claim 6 wherein said middle layer MD yarns interweave with both said upper and lower layer CMD yarns.

8. A papermakers fabric according to claim 4 wherein at least said upper MD yarns have an aspect ratio of at least 3:1.

9. A papermakers fabric according to claim 4 wherein said upper MD yarns are woven 100% warp fill.

10. A papermakers fabric according to claim 4 wherein all of said MD yarns have an aspect ratio of at least 3:1 and total at least 300% warp fill.

11. A papermakers fabric according to claim 4 wherein:

said upper MD yarns are woven with said upper layer CMD yarns and repeat with respect to four of said upper layer CMD yarns with a float of three yarns, and said lower MD yarns are woven with said lower layer CMD yarns and repeat with respect to four of said lower layer CMD yarns with a float of three yarns.

12. A papermakers fabric according to claim 11 wherein said MD yarns are interwoven with said CMD yarns in a balanced weave pattern such that said MD yarn system consists of two types of MD yarn triplets which are offset by two pairs of said upper and lower CMD yarns such that alternate upper and lower yarn pairs are not woven in knuckles by said upper and lower MD yarns.

13. A papermakers fabric according to claim 12 wherein the CMD yarns of said alternate CMD yarn pairs which are not woven in knuckles by said upper and lower MD yarns are larger in cross-sectional dimension than the CMD yarns which are woven in knuckles by said upper and lower MD yarns.

14. The fabric of claim 13 wherein:

the upper and lower MD yarns are 0.20 mm by 1.10 mm in cross-sectional dimensions, woven with surface floats and woven 22 MD yarn ends per inch, said intermediate yarns are 0.20 mm to 1.10 mm in cross-sectional dimensions, woven 22 MD yarn ends per inch, and the upper and lower CMD yarns are round, alternate between 0.70 mm and 0.50 mm in diameter and are woven 21 pairs of CMD yarns per inch such that the fabric has a permeability of 110 cfm.

15. A papermakers fabric having a multilayer system of CMD yarns and a system of flat monofilament MD yarns interwoven with said CMD yarns in a selected repeat pattern, wherein the MD yarn system is comprised of a paired upper and lower yarns stacked in the same relative vertical wherein said MD yarn system includes at least one intermediate subsystem of MD yarns disposed between said upper and lower MD yarns which interweaves with at least two layers of CMD yarns, and wherein the upper MD yarns and the lower MD yarns impart different surface characteristics to the opposing sides of the fabric by dominating both of the opposing sides.

16. The fabric of claim 15 wherein the at least some of the upper MD yarns are made of a first type of material and at least some of the lower MD yarns are made of a second different type of material.

17. A papermakers fabric according to claim 15 wherein at least said upper and lower machine direction yarns are flat monofilament yarns.

18. A papermakers fabric according to claim 17 wherein said flat monofilament yarns have an aspect ratio of at least 3:1.

19. An industrial fabric comprising:

a system of CMD yarns;

a system of flat monofilament MD yarns interwoven with said CMD yarns in a selected repeat pattern;

said MD yarns system having paired upper and lower yarns that are stacked in the same relative vertical alignment to each other throughout the body of the fabric; and said MD yarn system including at least one intermediate MD yarn disposed between said upper and lower MD yarns of each said MD yarn pairs which interweaves with at least two layers of CMD yarns.

20. A woven papermakers fabric of the type having a paper side which is in contact with a paper sheet and a machine side which is in contact with machine rollers, the woven fabric being comprised of:

a first system of longitudinal, monofilament flat machine direction yarns that dominate the paper side of the fabric;

a second system of longitudinal, monofilament flat machine direction yarns that dominate the machine side of the fabric;

an intermediate system of longitudinal, monofilament flat machine direction yarns;

a system of round cross machine direction yarns;

said system of round cross machine direction yarns including multiple layers; and yarns of the first, intermediate and second systems arranged in vertically stacked groups of first, intermediate and second machine direction yarns positioned one above the other in a superimposed relationship and being interwoven with the yarns of the cross machine direction system in a repeated pattern such that the intermediate yarns are interlaced with cross machine direction yarns of at least of two of said multilayers of cross machine direction yarns and do not appear on either the paper side or the machine side of the fabric.

* * * * *

UNITED STATES PATENT AND TRADEMARK OFFICE

CERTIFICATE OF CORRECTION

PATENT NO. : 5,343,896

DATED : September 6, 1994

INVENTOR(S) : Ernst Schroder and Henry J. Lee

It is certified that error appears in the above-identified patent and that said Letters Patent is hereby corrected as shown below:

At column 1, line 61, delete "as" and insert therefore --is--.

At column 6, line 50, delete "*b3u." and insert therefore --*3u.--

At column 11, line 23, after "inch" insert --,--.

At column 14, line 33, delete "ride" and insert therefore --side--.

In claim 14, at column 17, line 44, delete "to" and insert therefore --by--.

In claim 15, at column 17, line 55, delete "a".

Signed and Sealed this

Twenty-second Day of November, 1994

*Attest:*

Bruce Lehman

BRUCE LEHMAN

*Attesting Officer*

*Commissioner of Patents and Trademarks*